US008857807B2

(12) United States Patent
Mizutani et al.

(10) Patent No.: US 8,857,807 B2
(45) Date of Patent: Oct. 14, 2014

(54) SHEET PROCESSING APPARATUS AND SHEET CONVEYING METHOD

(75) Inventors: Kikuo Mizutani, Shizuoka (JP); Naofumi Soga, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 175 days.

(21) Appl. No.: 13/425,977

(22) Filed: Mar. 21, 2012

(65) Prior Publication Data

US 2012/0318157 A1 Dec. 20, 2012

Related U.S. Application Data

(60) Provisional application No. 61/499,160, filed on Jun. 20, 2011, provisional application No. 60/499,163, filed on Jun. 20, 2011.

(51) Int. Cl.

| | |
|---|---|
| ***B65H 29/52*** | (2006.01) |
| ***G03G 15/00*** | (2006.01) |
| ***B26D 5/34*** | (2006.01) |
| ***B26F 1/02*** | (2006.01) |

(52) U.S. Cl.

CPC ..... *B65H 29/52* (2013.01); *G03G 2215/00818* (2013.01); *G03G 15/6582* (2013.01); *B26D 5/34* (2013.01); *B26F 1/02* (2013.01); *B65H 2801/27* (2013.01)

USPC ..... 270/58.07

(58) Field of Classification Search

USPC ..... 270/58.07; 83/72, 76.7, 76.8, 81, 102, 83/105, 106, 162–166, 367, 403.1, 404, 83/405

See application file for complete search history.

(56) References Cited

U.S. PATENT DOCUMENTS

| | | | | |
|---|---|---|---|---|
| 6,120,015 | A * | 9/2000 | Albright et al. | 270/58.07 |
| 6,435,395 | B1 * | 8/2002 | Miyaguchi et al. | 227/27 |
| 8,042,796 | B2 * | 10/2011 | Iguchi | 270/58.07 |
| 8,196,923 | B2 * | 6/2012 | Kamiya et al. | 271/226 |

FOREIGN PATENT DOCUMENTS

| | | |
|---|---|---|
| JP | 4019605 | 12/2007 |
| JP | 2008-297099 | 12/2008 |
| JP | 2009-018357 | 1/2009 |

* cited by examiner

*Primary Examiner* — Leslie A Nicholson, III

(74) *Attorney, Agent, or Firm* — Patterson & Sheridan LLP

(57) ABSTRACT

A sheet processing apparatus includes a sheet regulating member that regulates the movement of a sheet in a space between a punch unit and a rear guide. The sheet regulating member may be set in an upper guide included in an upper part of the rear guide or may be set at a rear end in a sheet conveying direction of the punch unit. The sheet regulating member may be set between the punch unit and the rear guide and move following the movement of the punch unit.

12 Claims, 12 Drawing Sheets

SHEET PROCESSING APPARATUS AND SHEET CONVEYING METHOD

CROSS-REFERENCE TO RELATED APPLICATIONS

This application is based upon and claims the benefit of priority from the prior the U.S. Patent Application No. 61/499,160, filed on Jun. 20, 2011, and the prior the U.S. Patent Application No. 61/499,163, filed on Jun. 20, 2011, and the entire contents of which are incorporated herein by reference.

FIELD

Embodiments described herein relate generally to a sheet processing apparatus and a sheet conveying method.

BACKGROUND

An image forming apparatus such as a copy machine sometimes includes, between the image forming apparatus and a finishing apparatus, a punching apparatus that applies punching to a sheet.

The punching apparatus displaces a punching mechanism according to a skew, i.e., a lateral shift of a sheet conveyed from the image forming apparatus. The displacement of the punching mechanism makes it possible to apply punching to appropriate places even in a skewed sheet.

A space for the displacement is necessary to displace the punching mechanism. If a curl occurs in a sheet, a leading end of the sheet enters the space to cause a bend of the sheet.

Therefore, there is a demand for a sheet processing apparatus and a sheet conveying method that less easily cause a bend of a sheet.

DETAILED DESCRIPTION

Throughout this description, the embodiments and examples shown should be considered exemplars, rather than limitations on the apparatus and methods of the present invention.

A sheet processing apparatus and a sheet conveying method according to an embodiment are explained in detail below with reference to the accompanying drawings. Examples of an image forming apparatus include a copying machine, an MFP (Multifunction Peripheral), and a printer.

The sheet processing apparatus according to this embodiment includes a punch unit including a punch head configured to punch a sheet, a driving unit configured to pivot the punch unit in a pivoting direction along a sheet conveying direction, a first member arranged downstream in the sheet conveying direction of the punch unit and on an arrangement side of the punch unit and configured to guide the sheet being conveyed, a second member arranged to be opposed to the first member and configured to form, in conjunction with the first member, a conveying path on which the sheet is guided, and a sheet regulating member arranged between the punch unit and the first member and configured to regulate the movement of the sheet to a first member side in a space between the first member and the punch unit.

Configuration of the Sheet Processing Apparatus

Figure 1:
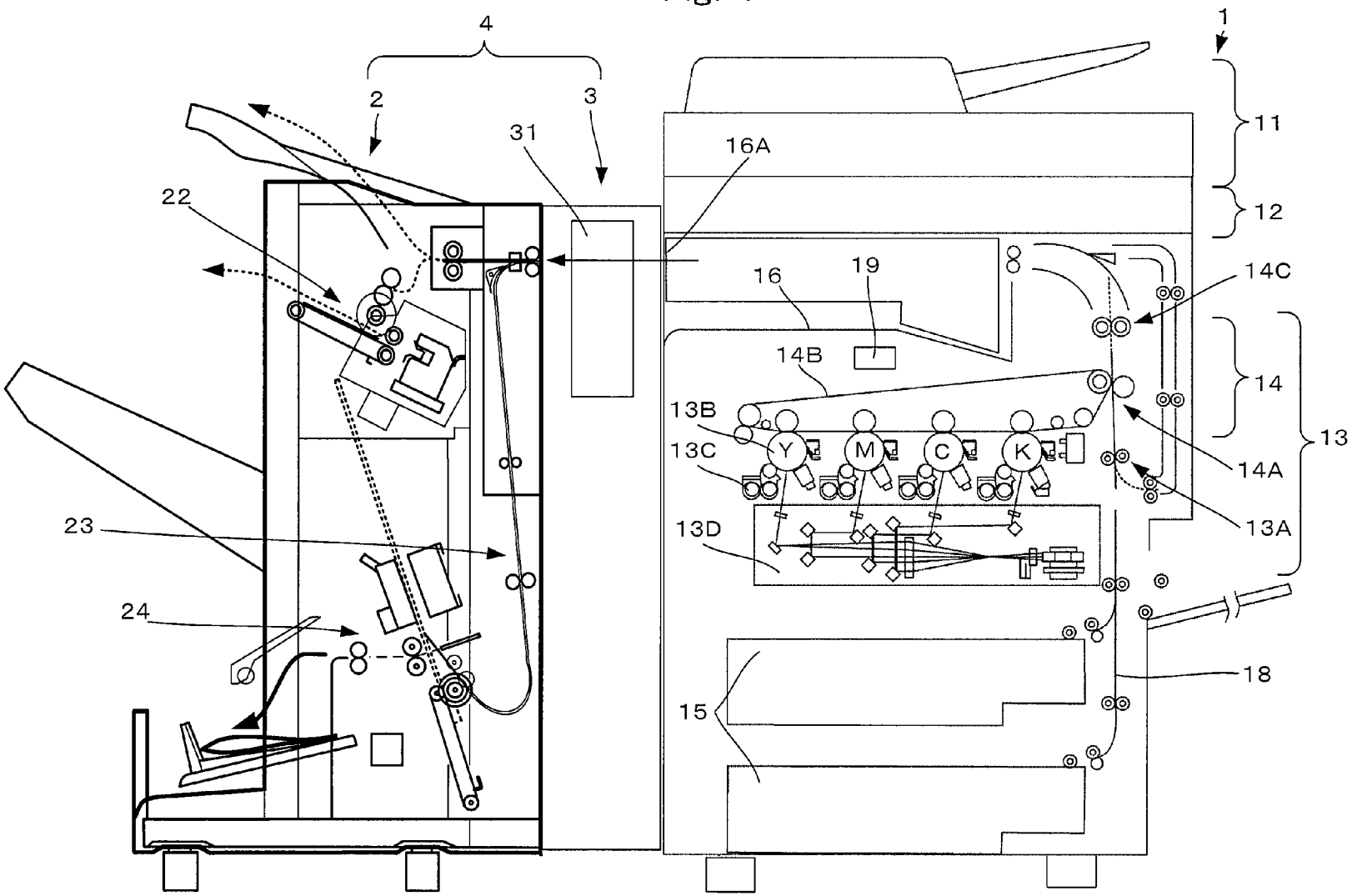
FIG. 1 is a diagram of the configuration of an image forming apparatus.

FIG. 1 is a diagram of the configuration of an image forming apparatus 1 according to this embodiment. As shown in FIG. 1, the image forming apparatus 1 includes an auto document feeder 11, an image reading section 12, an image forming section 13, a paper feeding unit 15, a sheet conveying mechanism 18, and a control section 19.

The auto document feeder 11 is openably and closably set in an upper part of a main body of the image forming apparatus 1. The auto document feeder 11 picks up original documents from a paper feeding tray one by one and conveys the original document to a document reading position of the image reading section 12. The image reading section 12 reads an image of the original document conveyed by the auto document feeder 11. When the auto document feeder 11 is pivoted upward, the image reading section 12 may read an original document placed on a document table by a user.

The image reading section 12 includes a carriage including an exposure lamp that exposures an original document to light and a first reflection mirror, plural second reflection mirrors that move according to the movement of the carriage, a lens block, and a CCD (Charge Coupled Device) of an image reading sensor.

The carriage stands still in the image reading section 12 or reciprocatingly moves under the document table to cause the first reflection mirror to reflect the light of the exposure lamp reflected by the original document. The plural second reflection mirrors causes the lens block to reflect the reflected light of the first reflection mirror. The lens block changes the magnification of the reflected light and outputs the reflected light to the CCD. The CCD converts the incident light into an electric signal and outputs the electric signal to the image forming section 13 as an image signal.

The image forming section 13 includes a registration roller 13A that corrects the direction of an obliquely conveyed sheet such that sides in a width direction of the sheet become parallel to the sheet conveying direction.

The image forming apparatus 1 forms, with the image forming section 13, an image on the sheet, the direction of which is corrected by the registration roller 13A.

An image forming method of the image forming section 13 may be any method. The image forming method of the image forming section 13 can be selected out of systems such as an electronic system and an inkjet system.

In the case of the electronic system, the image forming section 13 includes, for each of yellow Y, magenta M, cyan C, and black K, a laser irradiating unit 13D, a photoconductive drum 13B functioning as an electrostatic latent image bearing member and a developer supplying unit 13C, and a transfer section 14.

The laser irradiating unit 13D irradiates a laser beam on the photoconductive drum 13B on the basis of the image signal and forms an electrostatic latent image on the photoconductive drum 13B. The developer supplying unit 13C supplies a developer to the photoconductive drum 13B and forms a developer image from the electrostatic latent image.

The paper feeding unit 15 picks up sheets from a paper feeding cassette one by one and passes the sheet to the sheet conveying mechanism 18. The sheet conveying mechanism 18 conveys the sheet to the transfer section 14.

The transfer section 14 includes a transfer belt 14B and a transfer roller 14A. The transfer belt 14B functioning as an image bearing member receives the transfer of the developer image from the photoconductive drum 13B and bears the developer image. The transfer roller 14A applies a voltage to the developer image on the transfer belt 14B and transfers the developer image onto the sheet conveyed to the transfer roller 14A.

The image forming apparatus 1 includes a fixing device 14C downstream in the sheet conveying direction of the transfer section 14. The fixing device 14C heats and presses the developer image and fixes the developer image on the sheet.

In the case of the inkjet system, the image forming section 13 includes a head for spraying ink to the sheet.

The head includes an ink supply chamber in which piezoelectric elements having different polarities are stuck in a longitudinal direction and sets of the stuck piezoelectric elements are arranged in a comb tooth shape and a cover that has an ink ejection hole and covers the ink supply chamber. The image forming section 13 alternately applies voltages to the head to thereby deform the ink supply chamber and repeats suction of the ink and ejection of the ink from the ink ejection hole. The ejected ink adheres to the sheet and image formation is performed.

A sheet processing apparatus 4 is set adjacent to a sheet discharge section 16A for discharging the sheet subjected to the image formation in the image forming apparatus 1. The sheet processing apparatus 4 includes a finishing apparatus 2 and a punching apparatus 3.

The finishing apparatus 2 includes a sheet conveying mechanism 23 that conveys the sheet, a staple unit 22 that accumulates a predetermined number of sheets and staples the sheets, and a saddle folding unit 24 that accumulates a predetermined number of sheets, staples the sheets, and saddle-folds the sheets.

The punching apparatus 3 includes a punch unit 31 that applies punching to the sheet received from the image forming apparatus 1. The punching apparatus 3 applies punching to the sheet and passes the sheet to the finishing apparatus 2 behind the punching apparatus 3 or passes the sheet to the finishing apparatus 2 without applying punching to the sheet.

Sheet Regulating Member

First Embodiment

Figure 2:
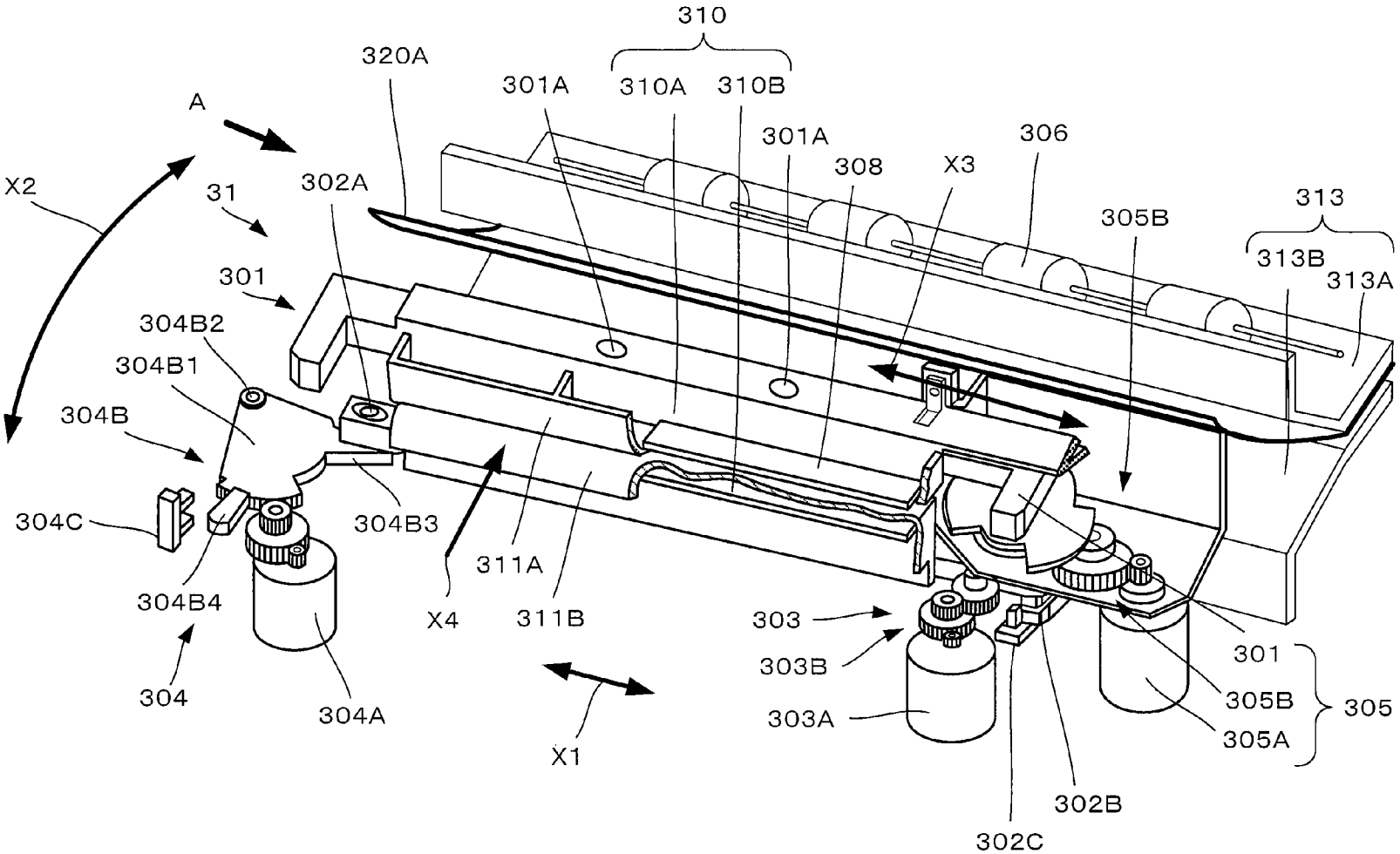
FIG. 2 is a perspective view of a main part of a punching apparatus in a first embodiment.
Figure 3:
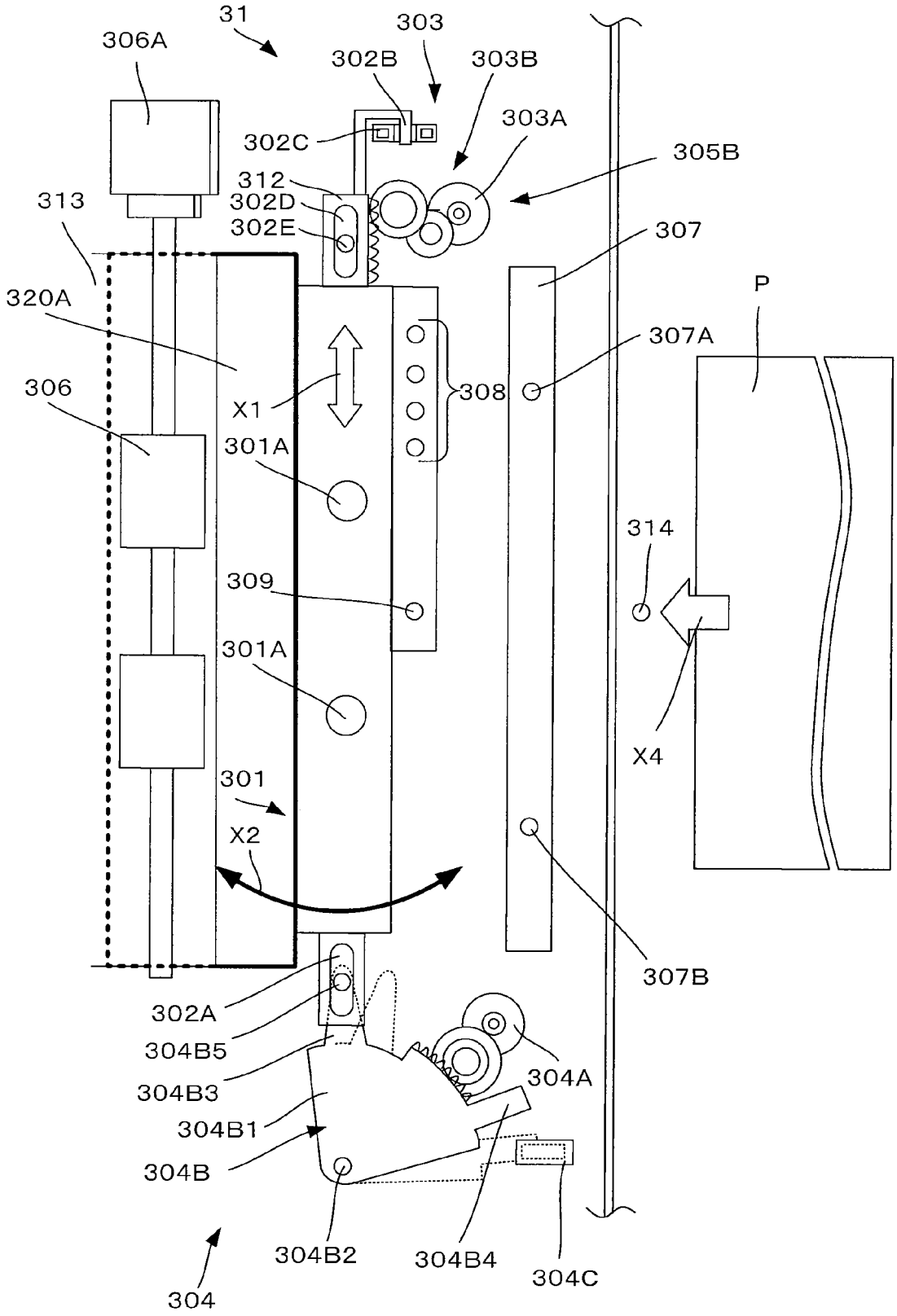
FIG. 3 is a plan view of the main part of the punching apparatus.

FIG. 2 is a perspective view of a main part of the punching apparatus 3 in a first embodiment. FIG. 3 is a plan view of the main part of the punching apparatus 3 in the first embodiment.

As shown in FIGS. 2 and 3, the punching apparatus 3 includes the punch unit 31, a lateral registration section 303 that moves the punch unit 31 and adjusts punching positions with respect a lateral shift of a sheet, and a pivoting registration section 304 that adjusts the punching positions with respect to a skew of the sheet.

The punch unit 31 includes plural punch heads 301A that punch the sheet, a punching section 310 including the punch heads 301A, and a driving section 305 that drives the punch heads 301A.

The punching section 310 includes a supporting section 310A that supports the punch heads 301A and a receiving section 310B including a hole for receiving edges of the punch heads 301A during punch processing.

Guides 311A and 311B that guide conveyance of the sheet are respectively attached to the supporting section 310A and the receiving section 310B of the punching section 310.

The punching section 310 includes lateral end sensors 308 that include light emitting sections and light receiving sections arranged to be opposed to each other via the guides 311A and 311B and detect the sheet when the sheet passes between the light emitting sections and the light receiving sections.

The driving section 305 includes a lifting and lowering section 305A and a gear 305B and a slide link 301 that transmit the power of the lifting and lowering section 305A to the punch heads 301A. The slide link 301 includes a not-shown cam on the inside of the supporting section 310A.

In this embodiment, when the power of the lifting and lowering section 305A is transmitted to the slide link 301 via the gear 305B, the slide link 301 slides in a direction indicated by an arrow X3. The cam converts the power of the slide motion of the slide link 301 into an up down motion of the punch heads 301A. The driving section 305 lowers the punch heads 301A to punch the sheet.

The driving section 305 can move integrally with the punching section 310.

The lateral registration section 303 adjusts the punching positions with respect to a shift in the width direction of the sheet orthogonal to the sheet conveying direction (hereinafter referred to as a lateral direction) of the punching section 310.

The lateral registration section 303 includes a laid and suspended member 312 attached to one end of the punching section 310, a pinion gear 303B, and a lateral registration driving section 303A functioning as a stepping motor.

The laid and suspended member 312 includes a rack. The power of the lateral registration driving section 303A is transmitted to the laid and suspended member 312 via the pinion gear 303B that meshes with the rack. The laid and suspended member 312 includes a lateral registration insert-through hole 302D, which is a through-hole long in the lateral direction. A lateral registration pin 302E fixed to a frame of the punch unit 31 is inserted through the lateral registration insert-through hole 302D.

The lateral registration section 303 includes a lateral registration actuator 302B and a lateral registration sensor 302C that detects a home position in the lateral direction of the punching section 310.

When the lateral registration driving section 303A is driven, the slide link 301 and the receiving section 310B are displaced in association with each other in the lateral direction indicated by an arrow X1 within a range of the length of the lateral registration insert-through hole 302D.

The pivoting registration section 304 includes a pivoting registration driving section 304A functioning as a stepping motor, a pivoting registration gear 304B functioning as a gear that transmits the power of the pivoting registration driving section 304A, a pivoting registration actuator 304B4 that indicates positions of a pivoting bar 304B3, which is provided a final reduction gear 304B1 of the pivoting registration gear 304B, and the receiving section 310B in a pivoting direction indicated by an arrow X2, a pivoting registration insert-through hole 302A, which is a through-hole long in the longitudinal direction of the receiving section 310B, and a pivoting registration sensor 304C that detects a home position in the pivoting direction of the receiving section 310B.

A pin 304B5 is provided in the pivoting bar 304B3. The pin 304B5 is inserted through the pivoting registration insert-through hole 302A.

When the pivoting registration driving section 304A is driven, the slide link 301 and the receiving section 310B are displaced in association with each other in the pivoting direction along the sheet conveying direction indicated by the arrow X2 within a range of the length of the pivoting registration insert-through hole 302A.

The punch unit 31 includes plural lateral end sensors 308 that detect lateral ends of a sheet P being conveyed, a passage sensor 309 that detects the passage of the sheet P, a skew detecting section 307 including a first skew sensor 307A and a second skew sensor 307B arranged in two places in the receiving section 310B over the width direction orthogonal to the sheet conveying direction, and an entry detection sensor 314 that detects the entry of the sheet P.

Rollers 306 and a roller driving section 306A that drives the rollers 306 are arranged downstream in the sheet conveying direction of the punch unit 31.

When the punch unit 31 performs punching, the sheet processing apparatus 4 drives the pivoting registration driving section 304A on the basis of the direction and the degree of a detected skew and displaces the pivoting bar 304B3 and the receiving section 310B to be parallel to the width direction of the sheet.

The sheet processing apparatus 4 selects the lateral end sensor 308 corresponding to the size of the sheet P. When the sheet P is conveyed to the sheet processing apparatus 4, the sheet processing apparatus 4 drives the lateral registration driving section 303A to displace the receiving section 310B until the lateral ends of the sheet P are detected according to an output of the lateral end sensor 308.

The sheet processing apparatus 4 displaces the receiving section 310B in a center direction of the sheet P on the basis of length set according to the sheet from a position where the lateral ends are detected.

The sheet processing apparatus 4 drives the lifting and lowering driving section 305A to apply punching to the sheet.

The rollers 306 pass the punched sheet to the finishing apparatus 2.

The sheet processing apparatus 4 further includes, downstream in the sheet conveying direction of the punch unit 31 included in the punching apparatus 3 and on a side where the punch unit 31 is arranged, a rear guide 313 that forms a sheet conveying path to regulate the movement of the sheet and passes the sheet to the finishing apparatus 2.

The rear guide 313 includes an upper guide 313A that functions as a first member and regulates the movement in an upward direction of the sheet and a lower guide 313B that functions as a second member and regulates the movement in a downward direction of the sheet.

The sheet processing apparatus 4 further includes a sheet regulating member that regulates the movement of the sheet in a space between the punch unit 31 and the rear guide 313.

The sheet regulating member performs regulation to prevent the sheet from entering the space between the punch unit 31 and the rear guide 313. Specifically, the sheet regulating member performs regulation to prevent the movement of the sheet to the first member side or the movement of the sheet to the punch unit 31 side. The sheet regulating member performs regulation to prevent the movement of the sheet deviating from the sheet conveying path to be turned up.

The sheet regulating member regulates the movement of the sheet and guides the sheet to the rear guide 313.

In this embodiment, the sheet processing apparatus 4 includes, as the sheet regulating member, in the upper guide 313A, a rear regulating member 320A formed of a flexible member that extends in the direction of the punch unit 31 and curves upward, i.e., in a thickness direction of the sheet on a side where the upper guide 313A functioning as the first member is arranged.

The width of the rear regulating member 320A is length equal to or smaller than the width of the sheet conveying path. The length in the sheet conveying direction of the rear regulating member 320A is desirably equal to or larger than length for allowing the rear regulating member 320A to come into contact with the punch unit 31. However, the length in the sheet conveying direction of the rear regulating member 320A may be smaller than this length as long as the rear regulating member 320A can perform regulation to prevent the movement of the sheet entering the space between the punch unit 31 and the rear guide 313, for example, upward movement of the sheet.

Figure 4A:
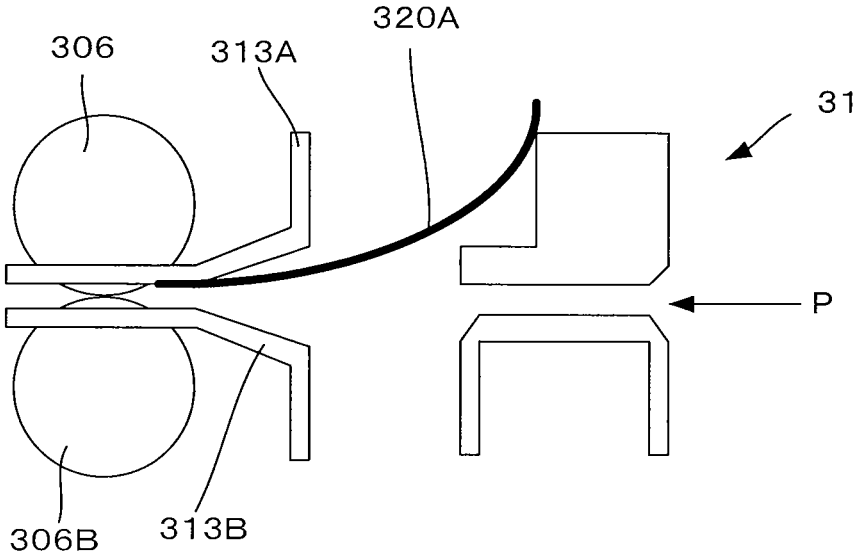
FIG. 4A is a side sectional view of the vicinity of a rear regulating member from which a punch unit moves away.

FIG. 4A is a side sectional view of the vicinity of the rear regulating member 320A from which the punch unit 31 moves away.

As shown in FIG. 4A, one end of the rear regulating member 320A is attached to a position where the end does not interfere with the rollers 306 on a surface of the upper guide 313A on a sheet conveying path side and driven rollers 306B that rotate following the rollers 306.

The other end of the rear regulating member 320A extends in the direction of the punch unit 31 and curves upward, i.e., in the thickness direction of the sheet on the side where the upper guide 313A functioning as the first member is arranged. The other end of the rear regulating member 320A desirably extends further upward, i.e., in the thickness direction of the sheet on the side where the upper guide 313A functioning as the first member is arranged than the punch unit 31.

The sheet is conveyed from a direction indicated by an arrow P. Even if the sheet curls upward and is about to enter the space between the punch unit 31 and the rear guide 313, the leading end of the sheet is regulated by the rear regulating member 320A and guided to the sheet conveying path of the rear guide 313.

Figure 4B:
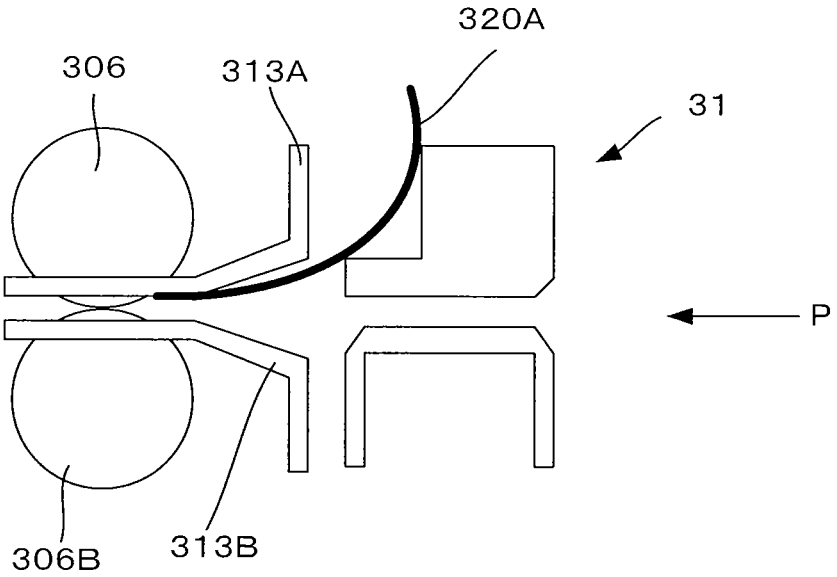
FIG. 4B is a side sectional view of the vicinity of the rear regulating member with which the punch unit comes into close contact.

FIG. 4B is a side sectional view of the vicinity of the rear regulating member 320A with which the punch unit 31 comes into close contact.

As shown in FIG. 4B, since the rear regulating member 320A is formed of the flexible member, even if the punch unit 31 comes into close contact with the rear regulating member 320A, the rear regulating member 320A is curved by the punch unit 31 upward, i.e., in the thickness direction of the sheet on the side where the upper guide 313A functioning as the first member is arranged. Therefore, the rear regulating member 320A does not prevent the action of the punch unit 31.

As explained above, the sheet processing apparatus according to this embodiment includes the rear regulating member 320A as the sheet regulating member.

Therefore, the sheet processing apparatus 4 according to this embodiment can suppress a bend from occurring in the sheet.

In the embodiment, one end of the rear regulating member 320A is attached to the rear guide 313 and the other end of the rear regulating member 320A comes into contact with a side surface of the punch unit 31 and curves along the side surface. However, the sheet regulating member is not limited to this form. For example, one end of the sheet regulating member may be attached to an upstream side in the sheet conveying direction of the punch unit 31 and the other end of the sheet regulating member may be brought into contact with a side surface of the skew detecting section 307 further upstream in the sheet conveying direction. In other words, the sheet regulating member may regulate the movement of the leading end of the sheet between the punch unit 31 and the skew detecting section 307.

Second Embodiment

Figure 5:
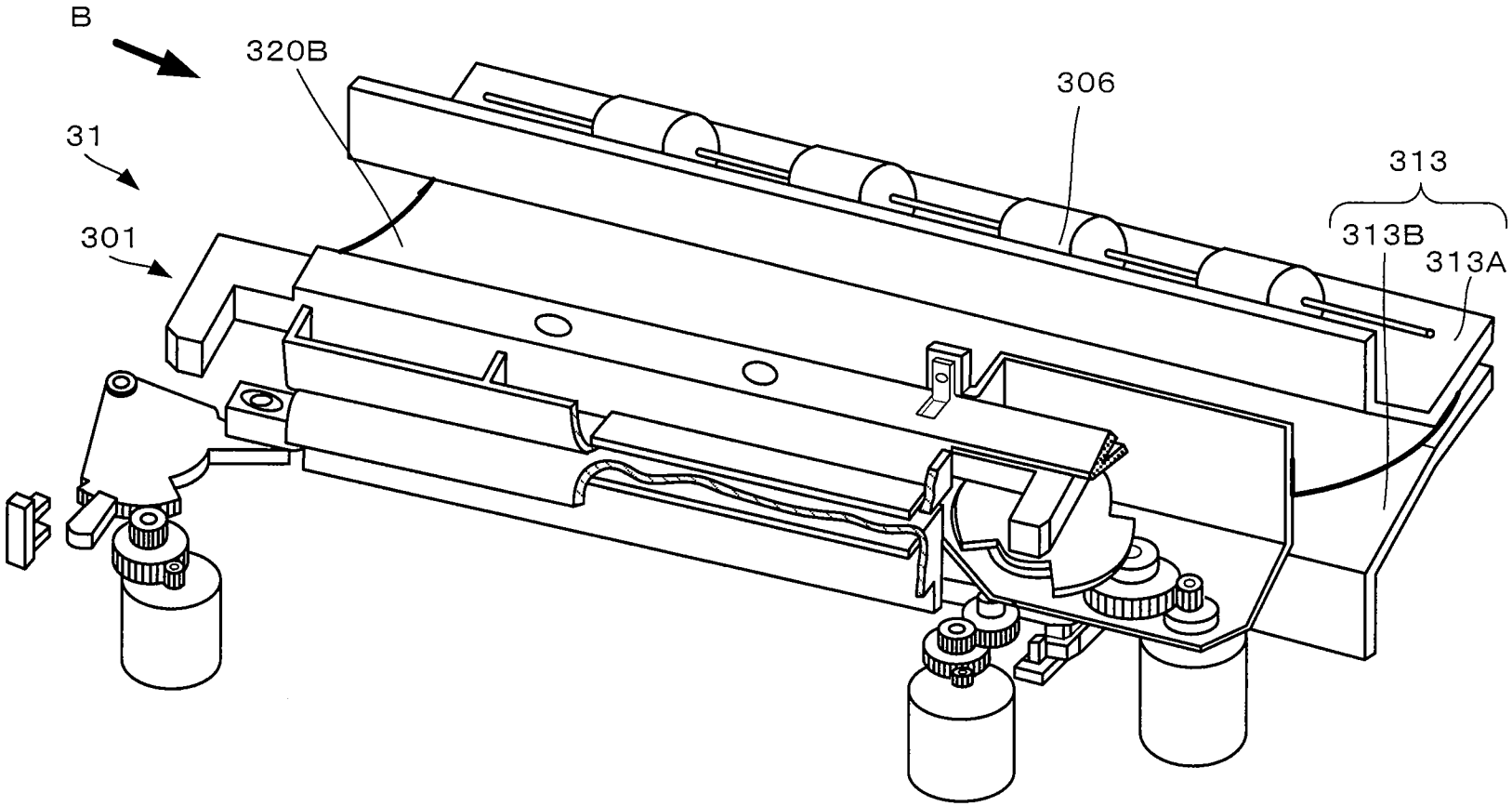
FIG. 5 is a perspective view of a main part of a punching apparatus in a second embodiment.
Figure 6:
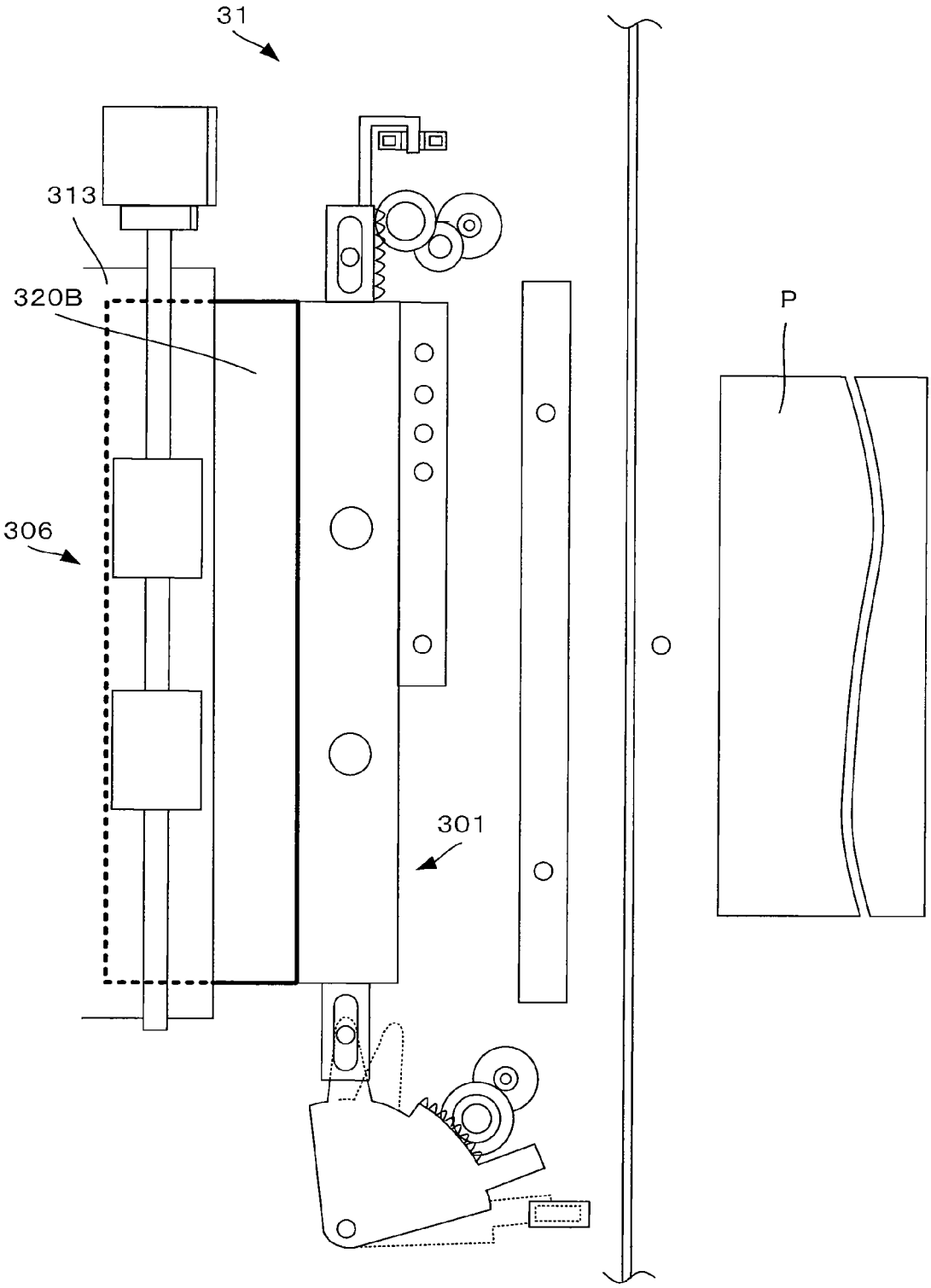
FIG. 6 is a plan view of the main part of the punching apparatus.

FIG. 5 is a perspective view of a main part of the punching apparatus 3 in a second embodiment. FIG. 6 is a plan view of the main part of the punching apparatus 3 in the second embodiment.

Components other than the sheet regulating member are the same as the components in the first embodiment.

As shown in FIGS. 5 and 6, in this embodiment, the sheet processing apparatus 4 includes, as the sheet regulating member, at a rear end in the sheet conveying direction of the punch unit 31, a front regulating member 320B formed of a flexible member that extends between the upper guide 313A and the lower guide 313B and curves upward, i.e., in the thickness direction of the sheet on the side where the upper guide 313A functioning as the first member is arranged.

The width of the front regulating member 320B is length equal to or smaller than the width of the sheet conveying path. The length in the sheet conveying direction of the front regulating member 320B is desirably equal to or larger than length for allowing the front regulating member 320B to reach a space between the upper guide 313A and the lower guide 313B and not to interfere with the rollers 306. However, the length in the sheet conveying direction of the front regulating member 320B may be smaller than this length as long as the front regulating member 320B can regulate the movement of the sheet entering into the space between the punch unit 31 and the rear guide 313, for example, the upward movement of the sheet.

Figure 7A:
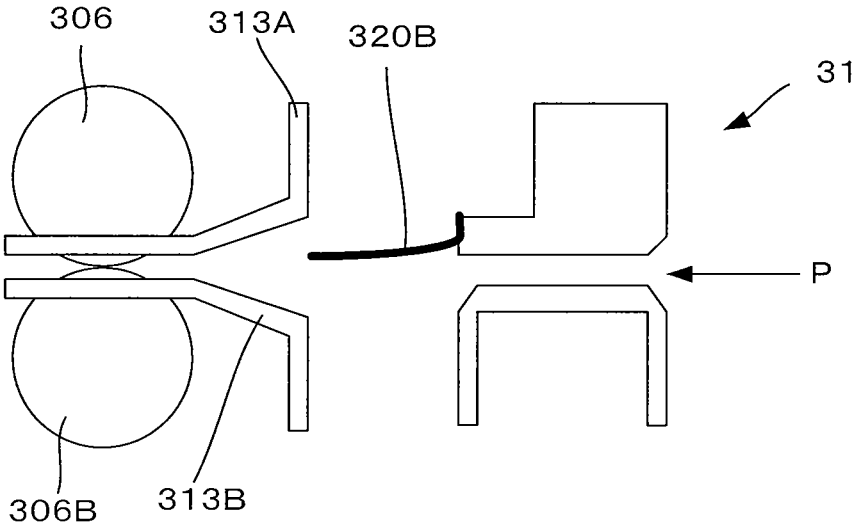
FIG. 7A is a side sectional view of the vicinity of a front regulating member from which a punch unit moves away.

FIG. 7A is a side sectional view of the vicinity of the front regulating member 320B from which the punch unit 31 moves away.

As shown in FIG. 7A, one end of the front regulating member 320B is attached to the rear end in the sheet conveying direction of the punch unit 31 and the other end of the front regulating member 320B extends in a direction of the space between the upper guide 313A and the lower guide 313B.

The sheet is conveyed from the direction indicated by the arrow P. Even if the sheet curls upward and is about to enter the space between the punch unit 31 and the rear guide 313, the leading end of the sheet is regulated by the front regulating member 320B and further regulated by the upper guide 313A. Therefore, the sheet is guided to the sheet conveying path of the rear guide 313.

Figure 7B:
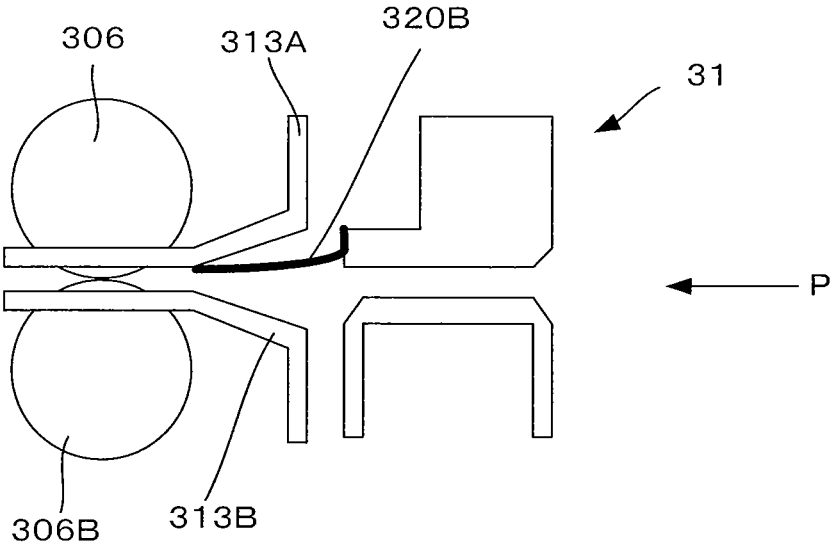
FIG. 7B is a side sectional view of the vicinity of the front regulating member with which the punch unit comes into close contact.

FIG. 7B is a side sectional view of the vicinity of the front regulating member 320B with which the punch unit 31 comes into close contact.

As shown in FIG. 7B, since the front regulating member 320B is formed of the flexible member, even if the punch unit 31 comes close to the rear guide 313, the front regulating member 320B is guided to the space between the upper guide 313A and the lower guide 313B by the upper guide 313A and does not prevent the action of the punch unit 31.

As explained above, the sheet processing apparatus according to this embodiment includes the front regulating member 320B as the sheet regulating member.

Therefore, the sheet processing apparatus 4 according to this embodiment can suppress a bend from occurring in the sheet.

Third Embodiment

Figure 8:
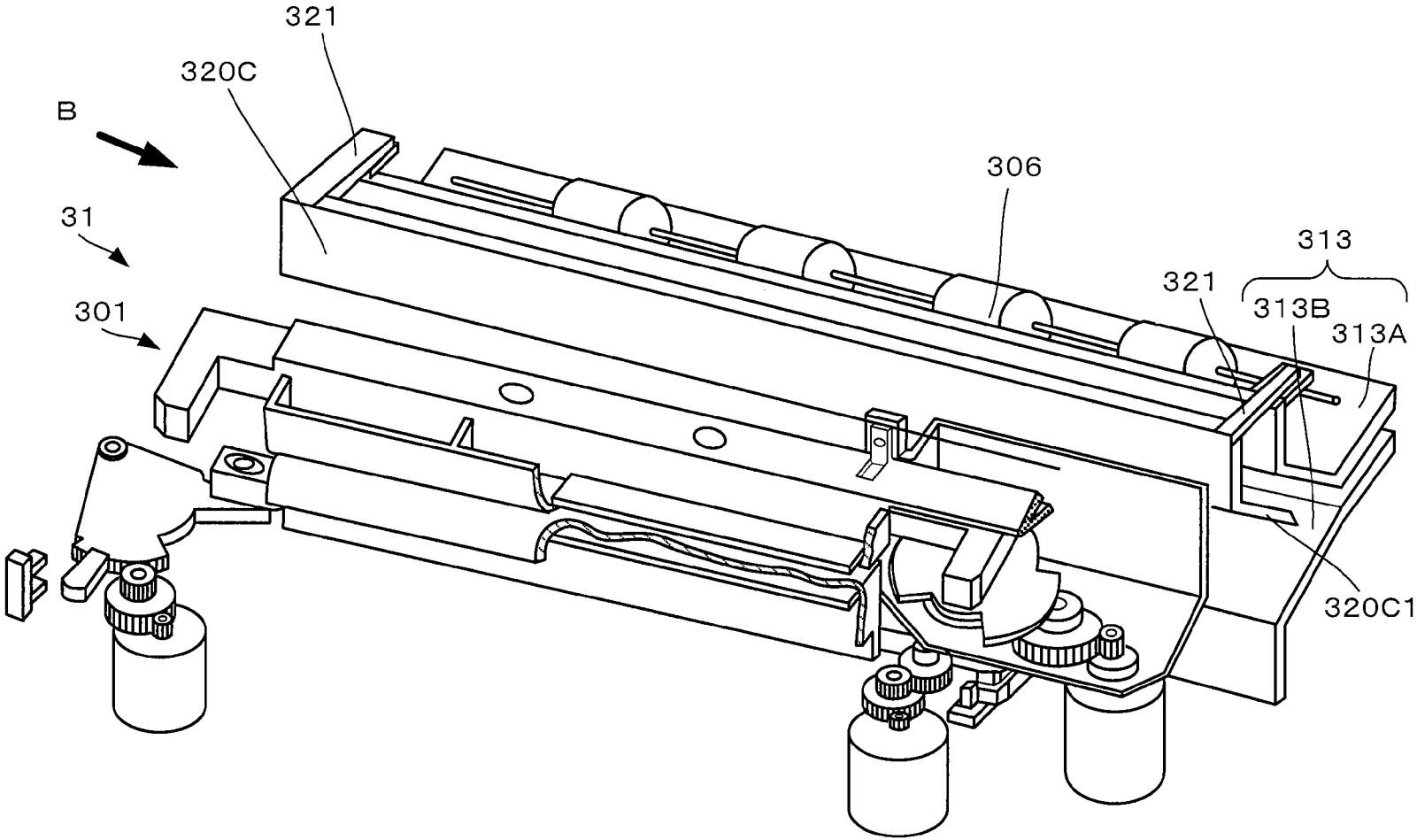
FIG. 8 is a perspective view of a main part of a punching apparatus in a third embodiment.
Figure 9:
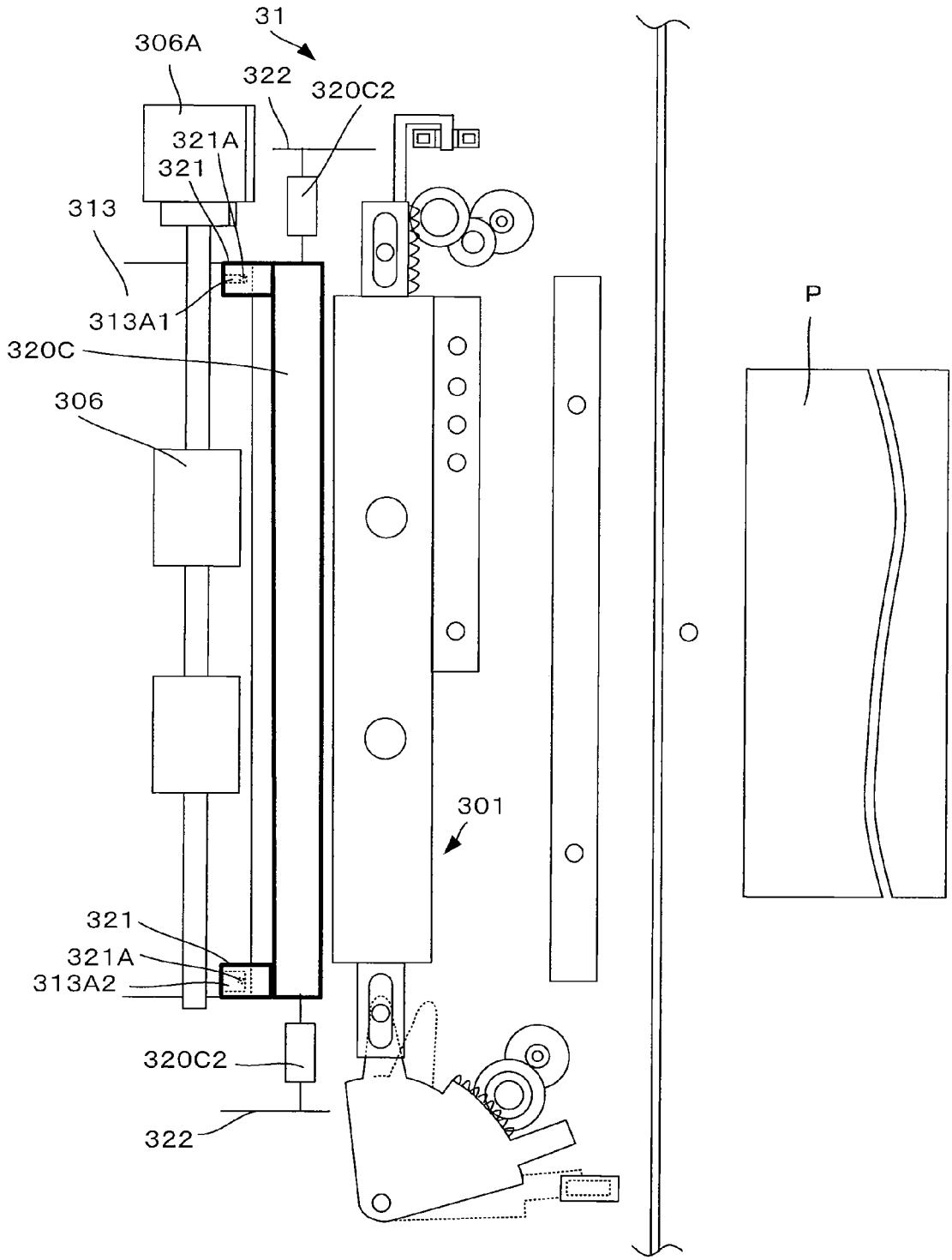
FIG. 9 is a plan view of the main part of the punching apparatus.

FIG. 8 is a perspective view of a main part of the punching apparatus 3 in a third embodiment. FIG. 9 is a plan view of the main part of the punching apparatus 3 in the third embodiment.

Components other than the sheet regulating member are the same as the components in the first embodiment.

As shown in FIGS. 8 and 9, in this embodiment, the sheet processing apparatus 4 includes, as the sheet regulating member, a movable regulating member 320C that is set between the punch unit 31 and the rear guide 313 and displaced according to the movement of the punch unit 31.

The width of the movable regulating member 320C is length equal to or smaller than the width of the sheet conveying path. The movable regulating member 320C is desirably formed of a member that is not easily deformed. However, the movable regulating member 320C may include a flexible member.

The movable regulating member 320C includes, at a lower end, a guide section 320C1 that guides the sheet to the space between the upper guide 313A and the lower guide 313B.

The movable regulating member 320C includes, at an upper end, attachment arms 321 including pins 321A.

The pins 321A are inserted through a first groove 313A1 and a second groove 313A2 provided at an upper end of the upper guide 313A.

The width of the first groove 313A1 is substantially the same as the outer diameter of the pins 321A. The width of the second groove 313A2 is larger than the width of the first groove 313A1.

The movable regulating member 320C includes, at both ends in the longitudinal direction, elastic members 320C2 such as springs that urge the movable regulating member 320C in the direction of the punch unit 31. The elastic members 320C2 are locked to a frame 322 of the punching apparatus 3.

Figure 10A:
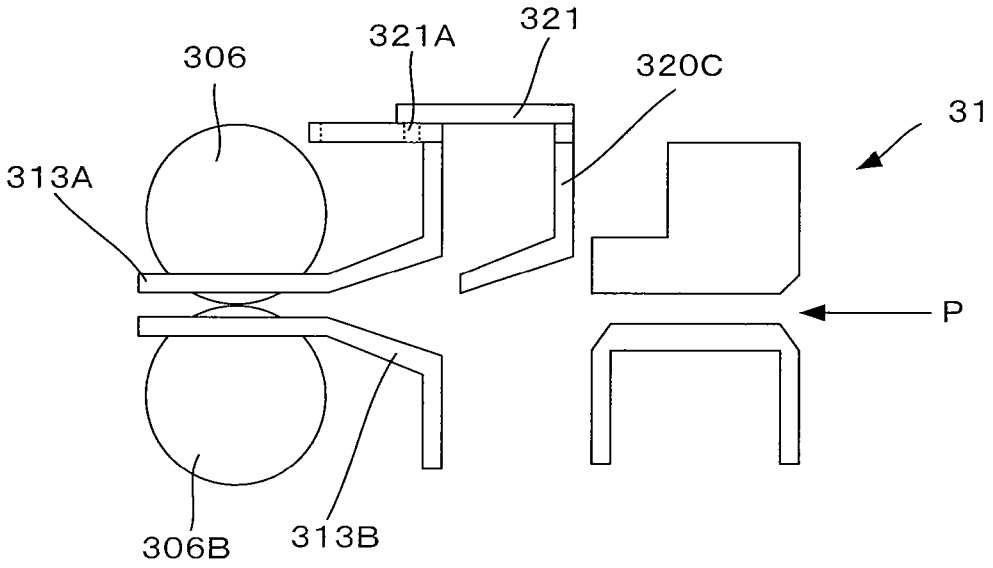
FIG. 10A is a side sectional view of the vicinity of a movable regulating member from which a punch unit moves away.

FIG. 10A is a side sectional view of the vicinity of the movable regulating member 320C from which the punch unit 31 moves away.

As shown in FIG. 10A, the guide section 320C1 is urged in the direction of the punch unit 31 by the elastic members 320C2 and comes into contact with the punch unit 31.

The sheet is conveyed from the direction indicated by the arrow P. Even if the sheet curls upward and is about to enter the space between the punch unit 31 and the rear guide 313, the leading end of the sheet is regulated by the guide section 320C1 and further regulated by the upper guide 313A. Therefore, the sheet is guided to the sheet conveying path of the rear guide 313.

Figure 10B:
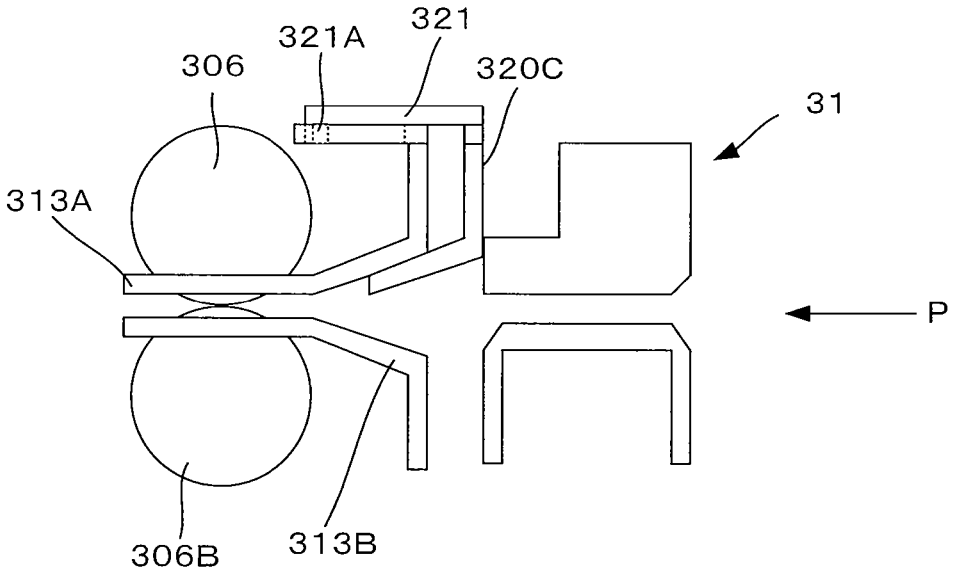
FIG. 10B is a side sectional view of the vicinity of the movable regulating member in a state in which the punch unit comes into close contact with a rear guide.

FIG. 10B is a side sectional view of the vicinity of the movable regulating member 320C in a state in which the punch unit 31 comes into close contact with the rear guide 313.

As shown in FIG. 10B, the guide section 320C1 of the movable regulating member 320C is formed in a shape in which the guide section 320C1 does not interfere with the rear guide 313 when the punch unit 31 comes into close contact with the rear guide 313.

Therefore, even if the punch unit 31 is displaced, the guide section 320C1 is displaced following the punch unit 31 and does not prevent the action of the punch unit 31.

Figure 11:
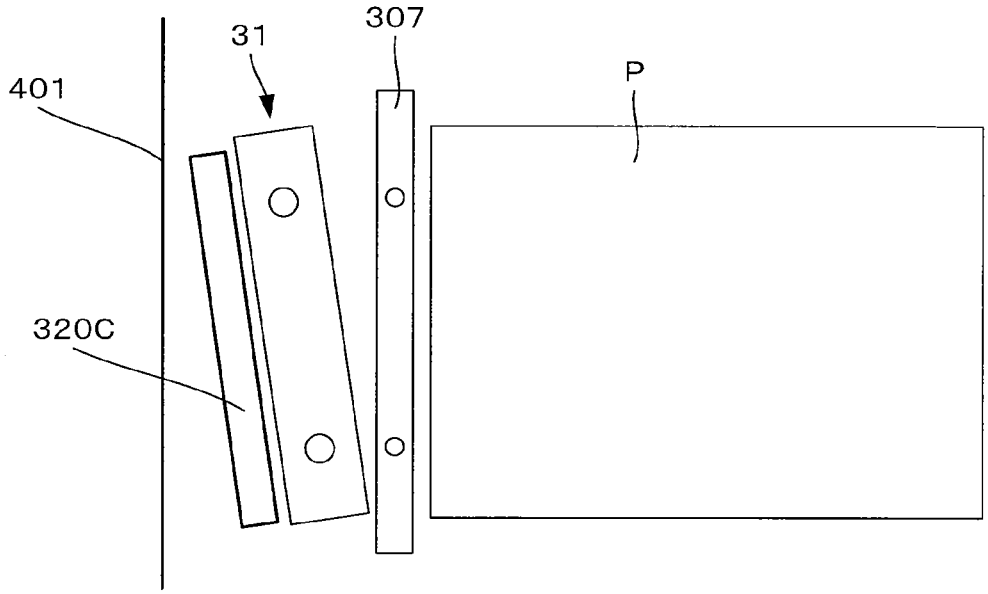
FIG. 11 is a diagram of a state in which the punch unit is present in a home position.
Figure 12:
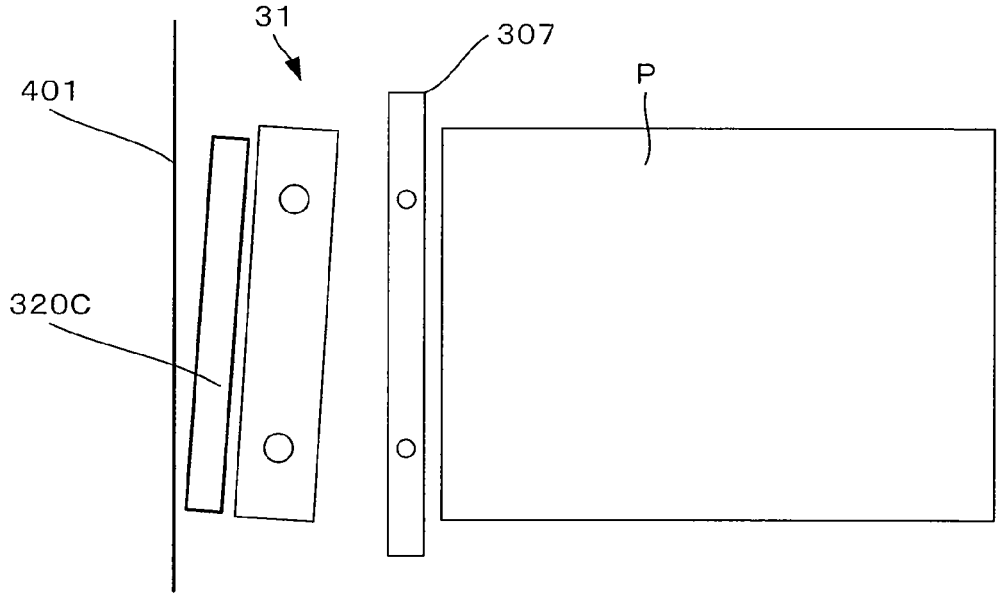
FIG. 12 is a diagram of a state in which the punch unit pivots.

FIG. 11 is a diagram of a state in which the punch unit 31 is present in a home position. FIG. 12 shows a state in which the punch unit 31 pivots.

As shown in FIGS. 11 and 12, the guide section 320C1 is displaced following the movement of the punch unit 31.

As explained above, the sheet processing apparatus 4 according to this embodiment includes the movable regulating member 320C as the sheet regulating member.

Therefore, the sheet processing apparatus 4 according to this embodiment can suppress a bend from occurring in the sheet.

Overall Configuration

Figure 13:
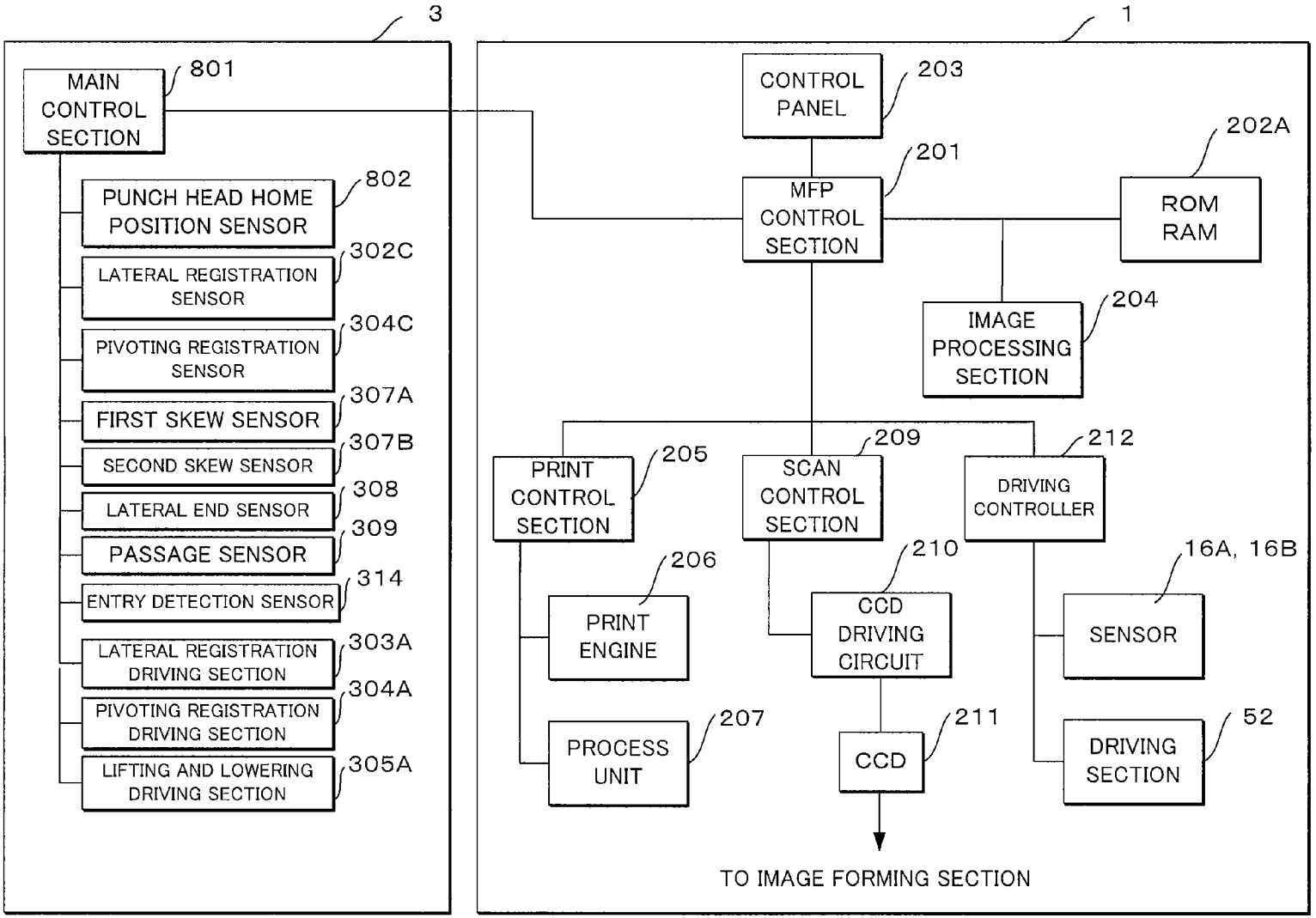
FIG. 13 is a block diagram of the configurations of the image forming apparatus and the punching apparatus.

FIG. 13 is a block diagram of the configurations of the image forming apparatus 1 and the punching apparatus 3. As shown in FIG. 13, the image forming apparatus 1 includes an MFP control section 201 functioning as the control section 19 that collectively controls the entire image forming apparatus 1, a ROM and RAM 202A functioning as a storage device, and an image processing section 204 that performs image processing.

The MFP control section 201 is connected to a print control section 205 that controls sections of an image forming system, a scan control section 209 that controls sections of an image reading system, and a driving controller 212 that controls a driving section.

In the case of the electronic system, the print control section 205 controls a print engine 206 that forms the electrostatic latent image on the photoconductive drum 13B and a process unit 207 that forms the developer image.

The scan control section 209 controls a CCD driving circuit 210 that drives a CCD 211. A signal from the CCD 211 is output to the image forming section 13.

The MFP control section 201, the print control section 205, and the scan control section 209 include CPUs functioning as arithmetic units.

The MFP control section 201 is connected to a main control section 801 that controls the punching apparatus 3.

The main control section 801 is connected to a punch head home position sensor 802 that detects a home position of the slide link 301, the lateral registration sensor 302C, the pivoting registration sensor 304C, the first skew sensor 307A, the second skew sensor 307B, the lateral end sensors 308, the passage sensor 309, and the entry detection sensor 314. The main control section 801 receives an input of outputs of the sensors.

The main control section 801 is connected to the lateral registration driving section 303A, the pivoting registration driving section 304A, and the lifting and lowering driving section 305A. The main control section 801 controls the actions of the driving sections.

The main control section 801 controls not only the action of the punch unit 31 but also the action of the finishing apparatus 2.

A control section of the finishing apparatus 2 can be configured to function as the main control section 801 and control the action of the punch unit 31.

The main control section 801 of the punch unit 31 detects entry speed of the sheet from outputs of the entry detection sensor 314 and the first skew sensor 307A or the second skew sensor 307B.

The main control section 801 detects the direction and the degree of a skew from outputs of the first skew sensor 307A and the second skew sensor 307B.

If the second skew sensor 307B detects a skew earlier than the first skew sensor 307A, the main control section 801 of the punch unit 31 determines that the sheet skews to a depth side. If the second skew sensor 307B detects a skew later than the first skew sensor 307A, the main control section 801 of the punch unit 31 determines that the sheet skews to the near side. If the first skew sensor 307A and the second skew sensor 307B are simultaneously turned on, the main control section 801 of the punch unit 31 determines that a skew does not occur.

If a skew occurs, the main control section 801 of the punch unit 31 detects the degree of the skew according to a difference between time when the first skew sensor 307A is turned on and time when the second skew sensor 307B is turned on.

Effects

As explained above, the sheet processing apparatus 4 includes the sheet regulating member that regulates the movement of the sheet in the space between the punch unit 31 and the rear guide 313.

Therefore, the sheet processing apparatus 4 according to this embodiment can suppress a bend from occurring in the sheet.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. A sheet processing apparatus comprising:

a punch unit including a punch head configured to punch a sheet, the punch head positioned on a first side of a conveying path along which the sheet is conveyed;

a driving unit configured to pivot the punch unit;

a first member positioned on the first side of the conveying path downstream of the punch unit in a sheet conveying direction and configured to guide the sheet being conveyed;

a second member positioned on a second side of the conveying path opposed to the first member and configured to form, in conjunction with the first member, a portion of the conveying path; and a sheet regulating member positioned between the punch unit and the first member and configured to block movement of the sheet into a space between the first member and the punch unit as the sheet is conveyed from the punch unit to the portion of the conveying path formed by the first and second guide members, and to guide the sheet to the portion of the conveying path formed by the first and second members, wherein a first end of the sheet regulating member is mounted to the first member and a second end of the sheet regulating member extends upstream in the sheet conveying direction and curves in a thickness direction of the sheet towards the first side of the conveying path.

2. The apparatus according to claim 1, wherein the sheet regulating member guides the sheet to between the first member and the second member.

3. The apparatus according to claim 1, wherein the sheet regulating member comes into contact with a side surface of the punch unit facing the first member and curves along the side surface.

4. The apparatus according to claim 3, wherein the sheet regulating member is formed of a flexible member.

5. The apparatus according to claim 4, wherein the space between the first member and the punch unit changes according to pivoting of the punch unit, and the sheet regulating member is displaced to close the space.

6. The apparatus according to claim 1, wherein the sheet regulating member includes:

a guide section formed in a curved shape; and an elastic member configured to urge the guide section in a direction of the punch unit, wherein the guide section is displaced according to movement of the punch unit.

7. The apparatus according to claim 6, wherein the guide section guides the sheet to between the first member and the second member.

8. A sheet conveying method for a sheet processing apparatus including a punch unit including a punch head configured to punch a sheet, the punch head positioned on a first side of a conveying path along which the sheet is conveyed, a first member positioned on the first side of the conveying path downstream of the punch unit in a sheet conveying direction, a second member positioned on a second side of the conveying path opposed to the first member and configured to form, in conjunction with the first member, a portion of the conveying path, and a sheet regulating member positioned between the punch unit and the first member, the method comprising:

blocking, with the sheet regulating member, movement of the sheet into a space between the first member and the punch unit as the sheet is conveyed from the punch unit to the portion of the conveying path formed by the first and second guide members;

guiding, with the sheet regulating member, the sheet to the portion of the conveying path formed by the first and second members; and guiding, with the sheet regulating member, the sheet to between the first member and the second member, wherein the sheet regulating member is attached to the first member, extends upstream in the sheet conveying direction, and curves in a thickness direction of the sheet towards the first side of the conveying path.

9. The method according to claim 8, further comprising bringing the sheet regulating member into contact with a side surface of the punch unit facing the first member so that the sheet regulating member curves along the side surface.

10. The method according to claim 9, wherein the sheet regulating member is formed of a flexible member.

11. The method according to claim 9, further comprising:

pivoting the punch unit and causing the space between the first member and the punch unit to change according to the pivoting; and displacing the sheet regulating member to close the changed space.

12. The method according to claim 8, wherein the sheet regulating member includes a guide section formed in a shape of the curve, the method further comprising:

urging the guide section in a direction of the punch unit;

pivoting the punch unit in; and displacing the guide section according to movement of the punch unit.

* * * * *